United States Patent [19]

Theurer et al.

[11] 4,014,389

[45] Mar. 29, 1977

[54] ENDLESS BALLAST CONVEYOR CHAIN

[75] Inventors: Josef Theurer, Vienna; Karl Folser, Linz-Urfahr, both of Austria

[73] Assignee: Franz Plasser Bahnbaumaschinen-Industrie-Gesellschaft m.b.H., Vienna, Austria

[22] Filed: July 21, 1975

[21] Appl. No.: 597,414

[30] Foreign Application Priority Data

Aug. 14, 1974 Austria ..... 6688/74

[52] U.S. Cl. ..... 171/16; 104/7 A; 37/107; 198/812

[51] Int. Cl.[2] ..... E01B 27/00

[58] Field of Search ..... 171/16; 37/104–107; 104/7 R, 7 A, 7 B; 56/292; 198/139, 208

[56] References Cited

UNITED STATES PATENTS

| | | | |
|---|---|---|---|
| 1,145,739 | 7/1915 | Bartges | 56/292 |
| 2,858,936 | 11/1958 | Ogden | 198/208 |
| 2,914,867 | 12/1959 | Scheuchzer et al. | 37/104 |
| 3,339,493 | 9/1967 | Bryan, Jr. | 104/7 A |
| 3,685,589 | 8/1972 | Plasser et al. | 171/16 |
| 3,818,619 | 6/1974 | Plasser et al. | 37/104 |

FOREIGN PATENTS OR APPLICATIONS

| | | | |
|---|---|---|---|
| 273,205 | 8/1969 | Austria | 171/16 |

*Primary Examiner*—Russell R. Kinsey

[57] ABSTRACT

The chain tensioning device for an endless ballast conveyor chain comprises a first, transverse chain guide for a stringer arranged to extend transversely of the track and therebelow and two longitudinally extending, pivotal chain guides rising from the transverse chain guide for two stringers arranged laterally of the machine frame and extending from respective ends of the first stringer, guide rollers being mounted at the ends for guiding the stringers in a polygonal path. One of the chain guides comprises an upper and a lower part movable in relation to each other in the direction of chain elongation. A power drive moves the two chain guide parts to adjust the effective length of the chain guide and thus selectively shortens or lengthens the effective circumference of the endless chain.

11 Claims, 7 Drawing Figures

ENDLESS BALLAST CONVEYOR CHAIN

The present invention relates to an endless conveyor chain mounted on the frame of a track working machine and preferably arranged to convey ballast from below the track to a ballast cleaning station.

Austrian patent No. 273,205 discloses such an endless conveyor chain for a ballast cleaning machine, which comprises a first stringer arranged to extend transversely of the track and therebelow, and two stringers arranged laterally of the machine frame and extending from respective ends of the first stringers. Guide rollers are mounted at the ends for guiding the stringers in a polygonal path. The chain tensioning device comprises a first, transverse chain guide for the first stringer and two longitudinally extending chain guides rising from the transverse chain guide for the laterally arranged stringers. The longitudinally extending chain guides are pivotal in respect of the machine frame to enable these chain guides to be raised and lowered as well as swung from side to side. In this known arrangement, the endless conveyor chain moves in a triangular path in a plane which is oblique with respect to the track plane. A chain drive, such as a dredger drum, is mounted at adjacent ends of the longitudinally extending chain guides at the apex of the triangular chain path while the guide rollers are mounted at the base of the triangle. To enable the endless chain to be tensioned, the longitudinally extending chain guides and the chain drive are movable in relation to each other in the direction of the track elongation. This relative motion to tension the chain often changes the conveyor path in the range of the dredger drum and this, in turn, changes the point of discharge of the ballast towards the center of the ballast cleaning screen. In this case, full use is not made of the entire surface of the screen for cleaning the ballast and this reduces the efficiency of the machine.

It is the primary object of this invention to provide a chain tension device in a machine of the indicated type which is simple in structure and operation.

This and other objects are accomplished in accordance with the invention by at least one of the chain guides comprising an upper and a lower part movable in relation to each other in the direction of chain elongation, and a drive for moving the two chain guide parts in relation to each other to adjust the effective length of the chain guide and thus selectively to shorten or lengthen the effective guide path of the endless conveyor chain.

This construction of the chain tensioning device makes it possible very simply, rapidly and sensitively to adjust the tension of the endless conveyor chain even during operation since it is not necessary to reposition such heavy and complex parts as the dredger drum. Furthermore, the chain may always be subjected to the desired tensioning force without changing the discharge point of the ballast on the screen.

In addition, the construction according to the present invention makes it possible to change not only the effective operating length of the endless conveyor chain but also the effective length of the chain guides at will to enable the structure to be extremely well adapted to various operating conditions encountered during track work.

The chain tensioning device of this invention enables the effective length of the chain guides to be selectively changed and thus to change the effective length of the selected stringers of the endless chain, particularly in the range of the transverse chain guide, i.e the part of the endless conveyor chain which dredges the ballast under the track, even without changing the circumferential length of the endless chain. Thus, it is possible almost continuously to lengthen the transverse stringer at track switch points, for instance, to take up all the ballast at such widened track points. The same may be done at extra-long ties, crossings and the like, all of which require an increase in the length of the transverse chain stringer. In these cases, the maximum length of the chain tension device is used to increase the length of the transverse chain guide.

The above and other objects, advantages and features of the invention will become more apparent from the following description of now preferred embodiments thereof, taken in conjunction with the accompanying schematic drawing wherein FIG. 1 is a side elevational view of a ballast cleaning machine incorporating an endless conveyor chain with a chain tensioning device according to the present invention;

Figures 1, 2, 3, 4:
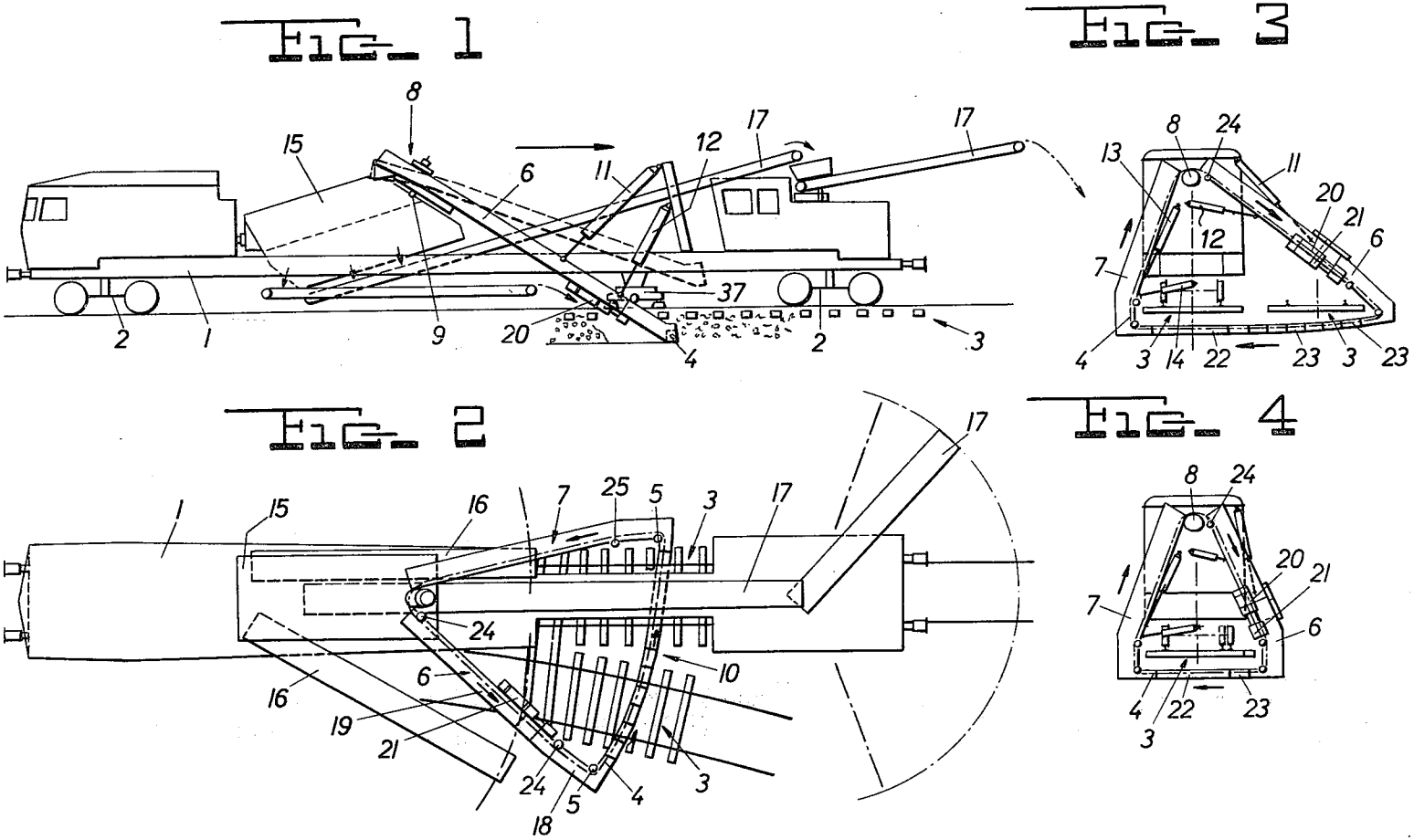
FIG. 2 is a top view of the machine of FIG. 1, the illustrated transverse chain guide having eight members so that the ballast under a track switch point may be fully dredged by the machine.
FIG. 3 is a rear view of the machine of FIG. 2, seen in the operating direction of the machine, the back cabin and ballast cleaning screen being removed for a better understanding of the essential parts of the apparatus.
FIG. 4 is a view similar to that of FIG. 3 but showing a transverse chan guide with only two members.

Referring now to the drawing and first to FIGS. 1 and 2, there is shown a ballast cleaning machine comprising frame 1 which is supported on undercarriages 2 for mobility on track 3 consisting of rails fastened to ties. The machine moves on the track in the direction of the horizontal arrow shown in FIG. 1 during the ballast cleaning operation. Ballast dredging chain 4 is mounted on machine frame 1 to remove the dirty ballast from the ballast bed on which the track rests. The endless ballast conveyor chain comprises a firs stringer arranged to extend transversely of the track and therebelow, and two stringers arranged laterally of the machine frame and extending from respective ends of the first stringer. Guide rollers or sprockets 5 are mounted at the ends for guiding the stringers in a triangular path.

The illustated chain tensioning device comprises transverse chain guide 10 for the first stringer and two longitudinally extending chain guides 6 and 7 rising from chain guide 10 for the laterally arranged endless chain stringers. The longitudinally extending chain guides are arranged in a plane extending obliquely to the track plane and are pivotal vertically as well as laterally for suitably positioning the path of the endless conveyor chain with respect to the machine frame. Universal pivot 9 mounts the upper ends of chain guides 6, 7 on machine frame 1 and chain drive 8, such as a dredger drum, is mounted at the adjacent ends of the longitudinally extending chain guides, the endless conveyor chain being trained over the drum which pulls one of the laterally arranged stringers along chain guide 7 therefor while the other laterally arranged endless chain stringer passes without load along chain guide 6 therefor. The lower ends of chain guides 6, 7 are linked to the ends of chain guide 10 below the track.

Chain guide 7 is preferably fixedly connected to chain drive 8 and the entire chain guide arrangement may be pivoted in a vertical and lateral direction by means of hydraulic motors 11, 12 linked respectively to machine frame 1 and chain guide 6, and hydraulic motors 13, 14 linked respectively to the machine frame and chain guide 7. The operation of hydraulic motors 12 and 14 is so controlled that motor 14 causes the entire lateral displacement of the chain guide arrangement transversely to the track during ballast dredging. The essential purpose of motor 12 is for pivoting chain guide 6 while chain guide 10 is lengthened or shortened during the preparation of the machine for a ballast dredging operation. Thus, hydraulic motor 14 alone determines the transverse position of the chain path with respect to the track and provides the sole power for pivoting the chain transversely with respect to the track and counteracting the force of hydraulic jack 12. In this manner, the two motors 12 and 14 need not be simultaneously operated in synchronism to adjust the conveyor chain transversely.

As shown by the arrows in FIGS. 2 to 4, the ballast is conveyed upwardly along chain guide 7 to vibratory ballast cleaning screen 15 where the ballast is discharged at chain drive 8 onto the screen, the stringer passing downwardly along chain guide 6 without load. Two longitudinally extending ballast conveyor bands 16 receive the cleaned ballast from the screen and return the same to the track bed, the conveyor bands being pivotal in a horizontal plane to enable them to be swung over the entire width of the track bed for distribution of the cleaned ballast thereover. The dirt and fines are removed by conveyor bands 17 and are thrown off laterally of the track, the terminal conveyor band 17 also being pivotal in a horizontal plane to enable the dirt and fines to be deposited at a desired location (see FIG. 2).

As shown in FIGS. 2 to 4, longitudinally extending chain guide 6 comprises an upper part 19 and a lower part 18 movable in relation to each other in the direction of chain elongation. As more fully illustrated in FIG. 6, drive means 20, 21 is arranged to move the two chain guide parts in relation to each other to adjust the effective length of chain guide. Since the stringer passes along this chain guide without load, the drive may be readily operated. No ballast being conveyed at this point, it cannot jam the movable chain guide parts. Also, the drive requires less power than would be required for moving loaded parts.

In the illustrated embodiment and as best shown in FIGS. 2 and 3, transverse chain guide 10 is comprised of a main member 22 and a selected number of additional members 23. In this manner and as shown in FIG. 3, the length of the transverse chain guide can be substantially adjusted by the insertion of seven additional members 23 while the length of endless conveyor chain 4 is correspondingly increased so that the machine may be adapted for dredging ballast under two parallel tracks 3 or at a track switch point. On the other hand and as illustrated in FIG. 4, the effective length of transverse chain guide 10 may be slightly increased by inserting a single additional member 23 without changing the overall length of the endless conveyor chain simply by using the relative movement of the two chain guide parts by means of drive means 20, 21 for correspondingly shortening guide 6.

As shown in the drawing, the guidance of the endless conveyor chain is improved by mounting two intermediate guide rollers 24 along guide 6 and guide rollers 25 along chain guide 7.

Figure 5:
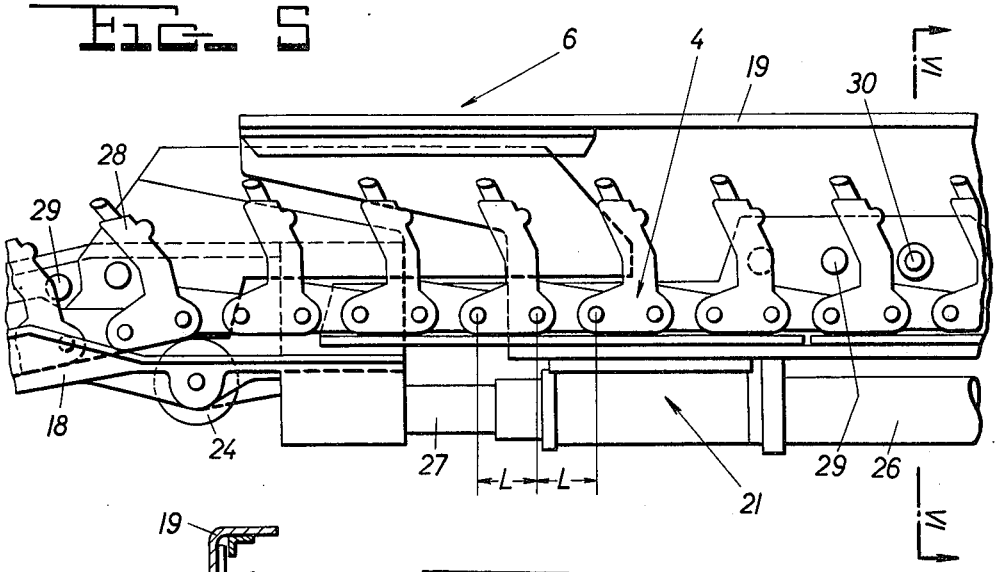
FIG. 5 is an enlarged top view showing a portion of the two chain guide parts movable relative to each other and the drive for moving the two parts.
Figure 6:
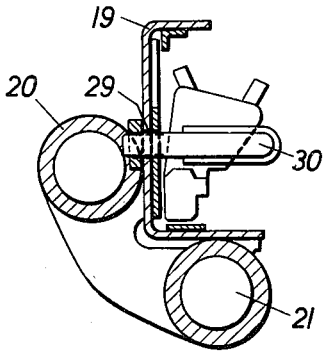
FIG. 6 is a sectional view along line VI—VI of FIG. 5.

The chain tensioning device proper, which is designed to compensate for the wear of the chain, i.e. of the bolts and bolt bearings between interconnected chain links 28, is most clearly shown in FIGS. 5 and 6 on an enlarged scale. It comprises the two relatively movable chain guide parts 18, 19 and the hydraulic motor drive means 20, 21 for moving the parts. The illustrated drive means is a remote-controlled hydraulic motor means comprising two hydraulic motors each consisting of cylinder 26 and piston 27. As shown in FIG. 5, cylinder 26 of motor 21 is affixed to upper chain guide part 19 while piston 27 is affixed to lower chain guide part 18. Hydraulic motors have the advantage that they may be operated from a central hydraulic fluid supply system advantageously used in the general operation of ballast cleaning machines.

FIG. 5 clearly shows chain links 28 which are linked together to form endless conveyor chain 4 and, as illustrated in FIG. 2, one of the intermediate sprockets 24 is mounted near the apex of the chain guide path for proper guidance of the chain.

As shown in the sectional view of FIG. 6, two like hydraulic motors 20, 21 are provided for the relative movement of chain guide parts 18 and 19, each motor being mounted on a wall of the chain guide part facing the track. In the illustrated embodiment, motor 21 is mounted on a longitudinal wall of chain guide 6 which faces machine frame 1 while motor 20 is mounted on the underside of the chain guide. This arrangement has the advantage that the drive motors can absorb the flexing and torsional forces at the abutment between the two chain guide parts and no further guide means for holding the parts in position are required. Mounting the cylinders on upper chain guide part 19 and the pistons on lower chain guide part 18 has the advantage that the larger effective piston surface may be used to exert the tensioning force most efficiently.

The telescoping bottom portions of chain guide parts 18, 19 consist of sheet metal plates or have linings which prevent the chain links of endless conveyor chain 4 from catching, regardless of the relative position of the two chain guide parts. Furthermore, these telescoping bottom portions each define a series of apertures 29 which are adapted, as seen in FIG. 6, to receive bolts 30 operating as clamping devices for holding a respective end link of chain 4 in position while one or more chain links 28 are either inserted to lengthen the chain or removed to shorten it. In this manner, if the chain path is to be increased by more than the distance by which the two chain guide parts can be relatively moved, additional chain links may be inserted into the chain while respective end links are clamped to the chain guide parts. The apertures 29 into which the clamping devices are inserted are preferably sufficiently spaced apart to enable at least one of the transverse chain guide members 23 to be removed or inserted.

If the tensioning device is to be used only for tensioning the chain and not to shorten or lengthen it, it is sufficient if chain guide parts 18, 19 are arranged to be movable in relation to each other by a distance at least equal to the length of one chain link. In this case, it will only be necessary to remove one chain link to make full use of the entire tensioning distance of the device.

Figure 7:
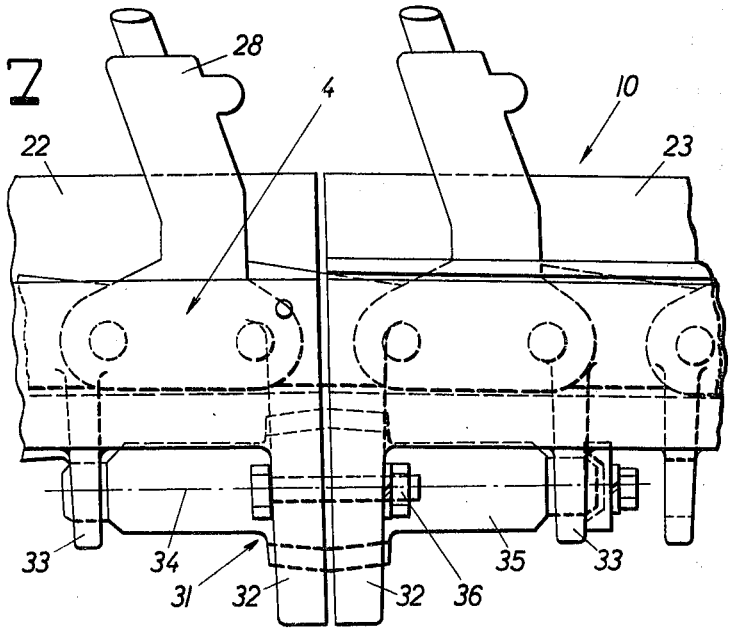
FIG. 7 illustrates a clamping device for interconnecting the chain guide parts.

As can be seen from FIGS. 3 and 4, the length of transverse chain guide 10 may be varied by inserting or removing one or more guide members 23, in addition to changing the length of longitudinally extending chain guide 6 by means of drive 20, 21. Clamping connection 31 between chain guide member 22 and chain guide member 23 (which is the same as between adjacent members 23) is shown in FIG. 7.

Endless conveyor link chain 4 is guided in transverse chain guide 10, ballast dredging and entraining fingers or shovels extending from the chain links into the ballast to entrain the same towards chain guide 7. Additional guide members 23, each of which preferably has a length corresponding to a multiple of the length of each chain link 28, are inserted in chain guide 10 from the rear, as seen in the operating direction of the chain. For this purpose, each chain guide member has a pair of ribs 32, 33 extending transversely of the member in the direction of the track adjacent an end of the member. Abutting ribs 32, 32 of two adjacent chain guide members have dove-tailed guides extending transversely of the ribs and symmetrically arranged in respect of transverse axis 34 and ribs 33 of the two adjacent guide members have bores concentric about the axis. Insertion of additional members in transverse chain guide 10 proceeds in the following manner, use being made of coupling part 35. Part 35 has a center portion with a pair of conical dove-tailed guides tapering inwardly towards the respective ends of the coupling part from the center thereof and two cylindrical guides at the coupling part ends. The dove-tailed guides of the coupling part are dimensioned to fit the dove-tailed guides in ribs 32 and the cylindrical guides fit the bores in ribs 33.

Coupling part 35 is inserted in ribs 32, 33 of chain guide member 23 and temporarily retained therein by a threaded fastener, one half of the coupling part projecting rearwardly from rib 32. The conforming guides in the ribs and coupling part serve to facilitate the insertion and position the coupling part on member 23. Member 23, with the projecting coupling part half is now moved towards chain guide member 22 until it is spaced from its end a distance at least equal to half the length of coupling part 35. At this point, hydraulic motors 12, 14 are operated to move laterally extending chain guides 6 and 7 towards each other in a direction transverse to the track elongation to guide the projecting half of coupling part 35 into engagement with ribs 32, 33 of chain guide member 22. This lateral movement is continued until ribs 32, 32 of members 22 and 23 abut, as shown in FIG. 7, with the coupling part interconnecting the two members. The two abutting ribs 32, 32 are now permanently held together to couple member 23 to member 22 by connecting bolt 36 inserted in the region of the conical dove-tailed guides. Member 23 is detached from member 22 by reversing the above-outlined steps.

The ends of chain guides 6 and 7 also have ribs 32, 33 to enable these chain guides to be assembled in the same manner.

Since such an extension of the chain guide also requires a lengthening of the conveyor chain, insertion of the additional chain links will be facilitated if these extra links are not provided with dredging buckets or fingers. Such simple chain links without ballast entrainment parts may be replaced after assembly of the extended chain guide by chain links carrying dredging parts, if desired.

The lengthening of the endless conveyor chain upon extension of the transverse chain guide will be simplified if, as shown in FIG. 5, the length of chain guide extension members 23 is a multiple of length L of chain links 28. We have found it most useful to provide extension members which have four times (4L) the length of the chain links. If the chain link length is, for instance, 125 mm, the length of chain guide extension members 23 will then be 500 mm.

Referring back to FIG. 1, the chain tensioning device of the present invention may be used in connection with ballast dredging chains on ballast cleaning machines of various types. If desired, such machines may include track lifting device 37 in the range of transverse chain guide 10 where the ballast is removed from the track bed for cleaning.

FIG. 1 shows the raised position of the ballast conveying chain assembly in broken lines, the assembly being raised by hydraulic jacks 11, 13 when the machine is moved from one working site to another. The working position of the assembly is shown in full lines in FIG. 1, in which position the transverse stringer of the chain is immersed in the ballast.

The drawing has not been encumbered by a showing of the generally conventional hydraulic operating circuit for the remote control of the various hydraulic drives described hereinabove and illustrated. As shown in FIGS. 3 and 4, hydraulic jack 12 is connected to upper chain guide part 19 in the upper third of no-load longitudinal chain guide 6. This assures a simple and easy lateral movement during insertion of several, relatively heavy extension members 23 in transverse chain guide 10. To make it possible to clean the ballast under a track switch point or even two parallel tracks, it is advantageous to design the hydraulic jack assembly so that the longitudinal chain guides may be laterally pivoted through a range permitting the insertion of up to eight or nine chain guide extension members.

It will be obvious to those skilled in the art that the hydraulic drives 20, 21 could be replaced by a spindle drive or any other suitable mechanical drive means capable of producing relative movement between the chain guide parts 18 and 19. The same holds true for the hydraulic jacks used to pivot the endless conveyor chain assembly laterally and/or vertically. Also, while the invention has been described in connection with a ballast cleaning machine, it could readily be applied to any type of endless conveyor chain. Furthermore, many structural variations and modifications may occur to those skilled in the art, particularly after benefitting from the present teaching, without departing from the spirit and scope of this invention, as defined in the appended claims.

What we claim is:

1. A track working machine comprising a frame, an endless conveyor chain mounted on the frame, the chain including a first stringer arranged to extend transversely of the track and therebelow, and two stringers arranged laterally of the machine frame and extending from respective ends of the first stringer, guide rollers mounted at the ends for guiding the stringers in a polygonal path, and a chain tensioning device including a chain guide assembly comprising a first, transverse chain guide on which the first stringer is mounted and two longitudinally extending chain guides rising from the transverse chain guide on which the laterally arranged stringers are mounted, at least one of the chain guides comprising an upper and a lower part movable in relation to each other in the direction of chain elongation, a drive for moving the two chain guide parts in relation to each other to adjust the effective length of the one chain guide and thus effectively to shorten or lengthen the effective circumference of the chain guide assembly for tensioning or loosening the endless chain mounted thereon, and means for pivoting the longitudinally extending chain guides with respect to the machine frame.

2. The track working machine of claim 1, wherein the chain is arranged to convey ballast from below the track to a ballast cleaning station.

3. The track working machine of claim 1, wherein the chain guide parts are arranged to be movable in relation to each other by a distance at least equal to the length of one chain link.

4. The track working machine of claim 1, wherein the drive for moving the two chain guide parts is a remote-controlled hydraulic motor means.

5. The track working machine of claim 4, wherein the chain guide parts have walls facing the track and the hydraulic motor means comprises two hydraulic motors each consisting of a cylinder-and-piston jack, each jack being mounted on the walls.

6. The track working machine of claim 5, wherein the jack cylinders are affixed to the upper chain guide part and the jack pistons are affixed to the lower chain guide part.

7. The track working machine of claim 1, further comprising a chain drive at adjacent ends of the laterally extending chain guides, the drive pulling one of the laterally arranged stringers along the chain guide therefor while the other laterally arranged stringer passes without load along the chain guide therefor, the chain guide for the other stringer comprising the two parts.

8. The track working machine of claim 7, wherein the two chain guide parts have clamping means at the ends thereof for holding end chain links in position in the chain guide during insertion or removal of additional chain links from the conveyor chain.

9. The track working machine of claim 1, wherein the transverse chain guide comprises a plurality of members, each of the members having a coupling device at respective ends thereof for interconnecting abutting ends of the members.

10. The track working machine of claim 9, wherein the length of said members is a multiple of the length of each chain link.

11. The track working machine of 9, further comprising hydraulic motor means for pivoting the longitudinally extending chain guides laterally with respect to the machine frame through a pivoting range permitting the insertion of up to nine of said members in the transverse chain guide.

* * * * *